US011352182B2

(12) United States Patent
Redford

(10) Patent No.: US 11,352,182 B2
(45) Date of Patent: Jun. 7, 2022

(54) MILK STORAGE SYSTEM AND ASSOCIATED METHODS

(71) Applicant: Walmart Apollo, LLC, Bentonville, AR (US)

(72) Inventor: Sarah A. Redford, Bella Vista, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 93 days.

(21) Appl. No.: 15/700,716

(22) Filed: Sep. 11, 2017

(65) Prior Publication Data

US 2018/0072477 A1 Mar. 15, 2018

Related U.S. Application Data

(60) Provisional application No. 62/393,309, filed on Sep. 12, 2016.

(51) Int. Cl.

| | |
|---|---|
| ***B65D 75/58*** | (2006.01) |
| ***B65D 85/80*** | (2006.01) |
| ***B65D 75/56*** | (2006.01) |
| ***B65D 33/25*** | (2006.01) |

(Continued)

(52) U.S. Cl.

CPC ..... *B65D 75/566* (2013.01); *B65D 33/004* (2013.01); *B65D 33/2508* (2013.01);

(Continued)

(58) Field of Classification Search

CPC .... B65D 33/065; B65D 33/14; B65D 75/566; B65D 85/80; B65D 75/522; B65D 75/58;

(Continued)

(56) References Cited

U.S. PATENT DOCUMENTS 3,140,039 A * 7/1964 Conti ..... B29C 65/18 383/9
3,204,855 A * 9/1965 Boynton ..... A61J 9/001 215/11.3

(Continued)

FOREIGN PATENT DOCUMENTS

JP 2007314245 A * 12/2007

OTHER PUBLICATIONS

JP2007314245Translation (Year: 2007).*

(Continued)

*Primary Examiner* — Jes F Pascua
*Assistant Examiner* — Nina K Attel
(74) *Attorney, Agent, or Firm* — Fitch, Even, Tabin & Flannery, LLP

(57) ABSTRACT

An example milk storage system and associated methods are described. The example milk storage system includes a milk storage bag with a body forming an inner chamber for receiving milk. The milk storage bag includes a first closure mechanism extending across the body and separating the body into a bottom section and a top section. The milk storage bag includes a preperforated section formed in both the first and second side walls of the top section of the body and spaced from edges of the top section. The preperforated section is removable from the top section of the body to form an opening extending through the top section. The milk storage system includes a hanging apparatus including a mounting section and an extension protruding from the mounting section. The extension passes through the opening in the milk storage bag to support the milk storage bag in a hanging orientation.

16 Claims, 6 Drawing Sheets

(51) Int. Cl.

| | |
|---|---|
| ***B65D 33/00*** | (2006.01) |
| ***B65D 75/04*** | (2006.01) |
| ***B65D 75/52*** | (2006.01) |
| *B31B 70/14* | (2017.01) |
| *B31B 160/10* | (2017.01) |

(52) U.S. Cl.
CPC ..... *B65D 33/2566* (2013.01); *B65D 75/04* (2013.01); *B65D 75/522* (2013.01); *B65D 75/5805* (2013.01); *B65D 75/5827* (2013.01); *B65D 85/80* (2013.01); *B31B 70/14* (2017.08); *B31B 2160/10* (2017.08)

(58) Field of Classification Search
CPC ..... B65D 75/5805; B65D 75/5811; B65D 75/5816; B65D 75/5822; B65D 75/5827; B65D 75/5833; B65D 75/5838; B65D 75/5844; B65D 75/585; B65D 75/5861; B65D 75/5866; B65D 33/004; B65D 33/25; B65D 33/2508; B65D 33/2516; B65D 33/2525; B65D 33/2533; B65D 33/2541; B65D 33/255; B65D 33/2558; B65D 33/2566; B65D 33/2575; B65D 33/2583; A61J 1/1462; A61J 9/001; A61J 9/005; A61J 9/0653; A61J 9/0661
USPC ..... 383/9, 22, 23, 24, 61.1, 63–65, 906; 211/85.13, 71.01, 72, 73, 85.15, 85.31; 215/11.3
See application file for complete search history.

(56) References Cited

U.S. PATENT DOCUMENTS

| | | | | |
|---|---|---|---|---|
| 5,385,251 | A | 1/1995 | Dunn | |
| 5,894,947 | A * | 4/1999 | Morano | B65D 33/007 215/11.3 |
| 6,962,439 | B2 * | 11/2005 | Taheri | B65D 33/004 383/204 |
| 2006/0074379 | A1 | 4/2006 | Hunt | |
| 2011/0293202 | A1 * | 12/2011 | Takeda | B65D 33/1691 383/6 |
| 2012/0051670 | A1 | 3/2012 | Matias | |
| 2012/0199595 | A1 * | 8/2012 | Makowski | A61J 1/1475 220/710 |
| 2013/0110037 | A1 * | 5/2013 | Simdon | A61M 1/062 604/74 |
| 2015/0048093 | A1 * | 2/2015 | Aki | B65D 33/2508 220/495.11 |
| 2016/0114090 | A1 * | 4/2016 | Patvibul | A61M 1/062 604/514 |

OTHER PUBLICATIONS

Ameda Store 'N Pour Breast Milk Storage Bags <http://www.buybuybaby.com/1/1/67742-breast-feeding-accessories-ameda-store-n-pour-breast-milk-storage-bags-40-count.html>Viewed Jul. 21, 2016, p. 1-5.

Avent Breast Milk Storage Bags <https://fsastore.com/product.aspx?productid=24119&utm_medium=LinkShare&utm_source=WUqD6wTpSTg&utm_campaign=323605&utm_content=24119&utm_term=&siteID=WUqD6wTpSTg-qToaJwXdEExW1LheS3ZVgQ>, Jul. 21, 2016, p. 1-2.

Evenflo Feeding Advanced Milk Storage Bags <http://www.toysrus.com/buylfood-storage/evenflo-advanced-milk-storage-bags-40-count-5241511-47857316>, Jul. 21, 2016, p. 1-7.

Lansinoh Breast Milk Storage Bags <http://www.amazon.in/Lansinoh-Breast-Milk-Storage-50-Count/dp/B00198I2WU>, Jul. 21, 2016, p. 1-7.

Milkies <http://www.fairhavenhealth.com/breast-milk-storage-bags.html> Jul. 21, 2016, p. 1-3.

* cited by examiner

MILK STORAGE SYSTEM AND ASSOCIATED METHODS

CROSS-REFERENCE TO RELATED PATENT APPLICATIONS

This application claims priority to U.S. Provisional Application No. 62/393,309, filed on Sep. 12, 2016, the content of which is hereby incorporated by reference in its entirety.

BACKGROUND

Milk storage bags are generally formed from flexible plastic and are used to contain breast milk for feeding a baby at a future time. Due to the amorphous shape of the milk storage bag containing breast milk, freezing of the breast milk generally involves stacking the milk storage bags on top of each other or on a rack in the freezer, which can use a large amount of space, results in undesired ripples in the milk storage bag when milk freezes, and/or results in the milk storage bag having a flat rectangular shape when the milk freezes making it difficult when trying to use the milk with a baby bottle. Some milk storage bags include preformed holes for attachment of the milk storage bag to a breast milk pump. Filling these milk storage bags can involve spillage or splashing of the breast milk through the preformed holes, resulting in a frustrating process for the user.

SUMMARY

Exemplary embodiments of the present disclosure provide a milk storage bag and associated systems and methods that allow for hanging of the milk storage bag during the freezing process without experiencing spillages of the breast milk through preformed holes during the filling process. In particular, the milk storage bag includes a preperforated section that is removable from the body after the milk storage bag has been filled with the breast milk and closed. Thus, the breast milk can be introduced into the milk storage bags without spillage through a preformed hole, and subsequently the user can remove the preperforated section to allow for hanging of the milk storage bag on a hanging apparatus (e.g., in the freezer). Hanging of the milk storage bag provides a convenient and organized way of storing the milk storage bags in the freezer, resulting in substantially ripple-free frozen milk storage bags.

In accordance with embodiments of the present disclosure, an exemplary milk storage system is provided that includes a milk storage bag. The milk storage bag includes a body with first and second side walls forming an inner chamber for receiving milk. The milk storage bag includes a first closure mechanism extending across the body and separating the body into a bottom section and a top section. The closure mechanism maintains the milk stored within the bottom section of the inner chamber. The milk storage bag includes a preperforated section (e.g., a preperforated hole) formed in both the first and second side walls of the top section of the body and spaced from edges of the top section. The preperforated section is removable from the top section of the body to form an opening extending through the top section. The milk storage system further includes a hanging apparatus including a mounting section and an extension protruding from the mounting section, the extension passing through the opening in the top section of the milk storage bag to support the milk storage bag in a hanging orientation.

The hanging apparatus can be configured and dimensioned to be removably mounted to a structure via the mounting section (e.g., to a wall or rack of a freezer). The body of the milk storage bag can be formed from a flexible material (e.g., a thin sheet of plastic sufficiently durable to maintain the milk within the bag). The body of the milk storage bag can be transparent. In some embodiments, the top section can include an area including a material configured to be written on. In some embodiments, the body can include a second closure mechanism extending across the body between the first closure mechanism and the preperforated section.

In some embodiments, the preperforated section can define a substantially round configuration. In some embodiments, the preperforated section can define a substantially oval configuration. In some embodiments, the preperforated section can include a reinforced perimeter to provide strength to the opening when the milk storage bag is in the hanging orientation. The milk storage bag can include a removable top connected to an edge of the top section along a preperforated line. Prior to separation of the removable top from the top section along the preperforated line, the inner chamber of the body can be sealed or substantially sealed from contaminants (e.g., the removable top maintains the inner chamber sealed from contaminants).

In accordance with embodiments of the present disclosure, an exemplary milk storage bag is provided that includes a body, a first closure mechanism, and a preperforated section. The body includes first and second side walls forming an inner chamber for receiving milk. The first closure mechanism extends across the body and separates the body into a bottom section and a top section, the closure mechanism maintaining the milk stored within the bottom section of the inner chamber. The preperforated section is formed in both the first and second side walls of the top section of the body and is spaced from edges of the top section. The preperforated section is removable from the top section of the body to form an opening extending through the top section.

The top section can include an area configured to be written on (e.g., a name section, a date section, a volume section, a time section, or the like). The milk storage bag can include a second closure mechanism extending across the body between the first closure mechanism and the preperforated section. In some embodiments, the preperforated section can define a round configuration. In some embodiments, the preperforated section can include a reinforced perimeter to provide strength to the opening when the milk storage bag is positioned in a hanging orientation. The milk storage bag includes a removable top connected to an edge of the top section along a preperforated line. Prior to separation of the removable top from the top section along the preperforated line, the inner chamber of the body can be sealed or substantially sealed from contaminants.

In accordance with embodiments of the present disclosure, an exemplary method of fabricating a milk storage bag is provided. The method includes forming a body with first and second side walls defining an inner chamber for receiving milk. The method includes forming a first closure mechanism extending across the body and separating the body into a bottom section and a top section. The closure mechanism can be configured to maintain the milk stored within the bottom section of the inner chamber. The method includes forming a preperforated section in both the first and second side walls of the top section of the body and spaced from edges of the top section. The preperforated section is removable from the top section of the body to form an opening extending through the top section. The method further includes forming a removable top connected to an edge of the top section along a preperforated line. The removable top maintains the inner chamber of the body sealed or substantially sealed from contaminants prior to separation of the removable top from the top section.

In accordance with embodiments of the present disclosure, an exemplary method of hanging a milk storage bag is provided that includes providing a milk storage bag as described herein. The method includes introducing milk into the bottom section of the milk storage bag, and closing the closure mechanism of the milk storage bag to maintain the milk stored within the bottom section of the inner chamber. The method includes removing the preperforated section from the top section of the body to form an opening extending through the top section. The method further includes hanging the milk storage bag on an extension of a hanging apparatus by passing the extension through the opening in the top section of the milk storage bag to support the milk storage bag in a hanging orientation.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the disclosed milk storage systems and associated methods, reference is made to the accompanying figures, wherein.

DETAILED DESCRIPTION

It should be understood that the relative terminology used herein, such as "front", "rear", "left", "top", "bottom", "vertical", "horizontal", "up" and "down" is solely for the purposes of clarity and designation and is not intended to limit embodiments to a particular position and/or orientation. Accordingly, such relative terminology should not be construed to limit the scope of the present disclosure. In addition, it should be understood that the scope of the present disclosure is not limited to embodiments having specific dimensions. Thus, any dimensions provided herein are merely for an exemplary purpose and are not intended to limit the invention to embodiments having particular dimensions.

Exemplary embodiments of the present disclosure provide a milk storage bag and associated systems and methods that allow for hanging of the milk storage bag for the freezing process after the milk storage bag has been filled with milk. In particular, the milk storage bag includes a preperforated section that is removable from the body after the milk storage bag has been filled with the milk and closed. Thus, the milk can be introduced into the milk storage bags through a top opening without spillage through a preformed hole. Subsequent to filling the milk storage bag with the milk, the user can remove the preperforated section to allow for hanging of the milk storage bag on a hanging apparatus (e.g., in the freezer). Hanging of the milk storage bag provides a convenient and organized way of storing the milk storage bag in the freezer, resulting in substantially ripple-free frozen milk storage bags.

Figure 1:
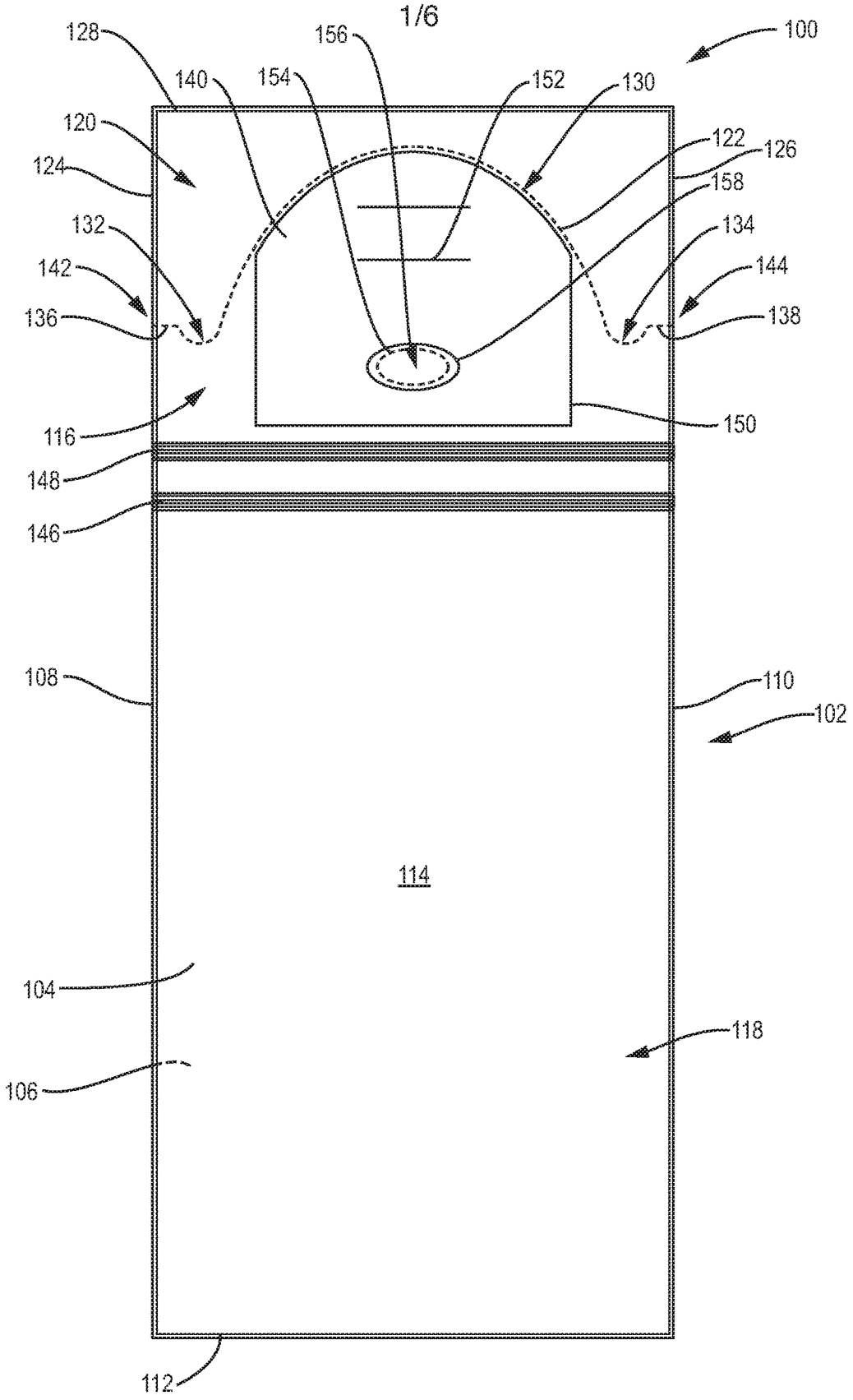
FIG. 1 is a schematic front view of an exemplary milk storage bag of the present disclosure including a removable top.

FIG. 1 shows a front view of an exemplary milk storage bag 100 (hereinafter "bag 100") according to the present disclosure. The bag 100 generally includes a body 102 with first and second side walls 104, 106. The first and second side walls 104, 106 can be of substantially similar configurations and dimensions. In particular, the first and second side walls 104, 106 can be formed from two thin sheets (e.g., transparent, flexible plastic sheets) that are disposed over each other and sealed along side edges 108, 110 and a bottom edge 112. The sealed first and second side walls 104, 106 thereby form an inner chamber 114 configured and dimensioned to receive milk.

The body 102 includes a top section 116 and a bottom section 118. The top section 116 can be used to introduce milk into the inner chamber 114, while the bottom section 118 can be sealed to maintain the milk within the bag 100. The bag 100 includes a removable top 120 detachably extending from the top section 116. The removable top 120 can also be formed from two thin sheets disposed over each other. The removable top 120 can extend from and along the entire top edge 122 of the top section 116. The connection between the removable top 120 and the top section 116 along the top edge 122 can be in the form of a preperforated line such that the removable top 120 can be detached from the top section 116 prior to filling the bag 100 with milk.

The side edges 124, 126 and the top edge 128 of the removable top 120 can be sealed. Thus, the removable top 120 can maintain the inner chamber 114 of the body 102 sealed (or substantially sealed) from contaminants prior to use of the bag 100. In some embodiments, the side edges 124, 126 of the removable top 120 can remain separated from each other while still maintaining the inner chamber 114 substantially sealed from contaminants prior to use of the bag 100. When a user is ready to introduce milk into the inner chamber 114, the removable top 120 can be separated from the top section 116 along the top edge 122.

In some embodiments, the top edge 122 can define a substantially symmetrical configuration along a central longitudinal axis. The top edge 122 can include multiple curves (e.g., a central concave curvature 130 transitioning into side convex curvatures 132, 134, and further transitioning into linear portions 136, 138 up to the side edges 108, 110). When the removable top 120 is detached from the top section 116, the central concave curvature 130 can define flaps 140 for separating the two sheets of the body 102 to define an opening therebetween for introducing milk into the inner chamber 114. The side convex curvatures 132, 134 and the linear portions 136, 138 can form a spout configuration 142, 144 on either side of the top section 116 for pouring the milk out of the inner chamber 114 and into a baby bottle.

The bag 100 includes a first closure mechanism 146 extending across the body 102 between the side edges 108, 110 and separating the top section 116 from the bottom section 118. In some embodiments, the first closure mechanism 146 can be in the form of interlocking plastic edges formed on the inside surface of the first and second side walls 104, 106 (e.g., similar to a ZIPLOC® bag closure system). The first closure mechanism 146 maintains the bottom section 118 and the inner chamber 114 sealed from the opening formed between the flaps 140 of the top section 116, thereby preventing contamination of the milk within the inner chamber 114. In some embodiments, the bag 100 can include a second closure mechanism 148 extending across the body 102 and functioning substantially similarly to the first closure mechanism 146. The second closure mechanism 148 can be disposed between the first closure mechanism 146 and the top section 116, and can provide additional sealing of the inner chamber 114. In some embodiments, the first and second closure mechanisms 146, 148 can be configured to close simultaneously. For example, closing the first closure mechanism 146 can simultaneously close the second closure mechanism 148 (and vice versa) to ensure closure of the inner chamber 114.

The top section 116 of the body 102 includes a notation area 150 with one or more lines 152. The notation area 150 can be written on by a user to add notes regarding the contents of the bag 100. For example, the notation area 150 can be used to add notes regarding the date and/or time on which the milk was introduced into the inner chamber 114, the volume of milk within the inner chamber 114, a user or baby name, combinations thereof, or the like. In some embodiments, the notation area 150 can be painted a different color, e.g., white, to be more conducive for being written on with a pen and/or marker.

The top section 116 further includes a preperforated section 154 formed in both the first and second side walls 104, 106. The preperforated section 154 is spaced from the side edges 108, 110 and top edge 122 of the top section 116. In some embodiments, the preperforated section 154 can be aligned with a central longitudinal axis of the bag 100. The preperforated section 154 can be located above the second closure mechanism 148. The preperforated section 154 can define a variety of shapes, e.g., circular, oval, rectangular, square, triangular, hexagonal, or the like.

The perimeter of the preperforated section 154 is formed by a perforated line such that the preperforated section 154 can be removed from the top section 116 by the user to form an opening 156 extending through the top section 116. In particular, the user can initially pour the milk into the inner chamber 114 by separating the flaps 140 on each of the first and second side walls 104, 106 to form an opening into the inner chamber 114. Maintaining the preperforated section 154 attached to the top section 116 during pouring of the milk into the inner chamber 114 prevents or reduces spillage and splashing of the milk out of the bag 100.

After the milk has been poured into the inner chamber 114, the first and/or second closure mechanisms 146, 148 can be interlocked to seal the milk within the inner chamber 114. At this point, the user can remove the preperforated section 154 from the top section 116 along the perforated line to expose the opening 156. The opening 156 can be used to hang the bag 100 on a hanging apparatus or hook for storage (e.g., within the freezer). In some embodiments, the perimeter of the opening 156 can include a reinforced section 158 that provides strength to the opening 156 when the bag 100 is in the hanging orientation. For example, the reinforced section 158 can be formed from a more durable material than the bag 100 to prevent ripping of the opening 156 due to the weight of milk within the inner chamber 114.

Figure 2:
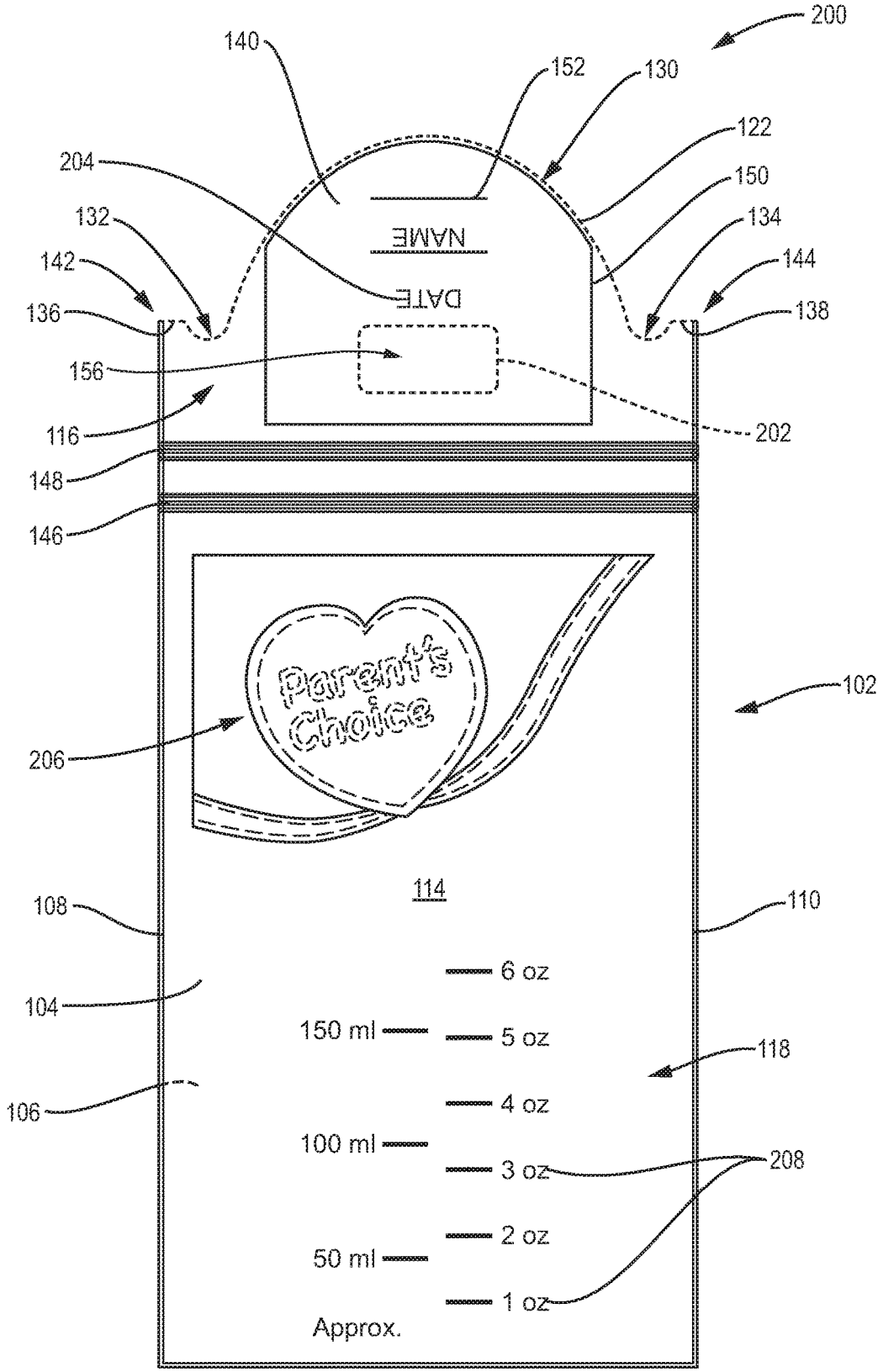
FIG. 2 is a schematic front view of an exemplary milk storage bag of the present disclosure with a removable top separated from the body of the milk storage bag.

FIG. 2 is a partial front view of an exemplary milk storage bag 200 (hereinafter "bag 200") of the present disclosure. The bag 200 can be substantially similar in structure and function to the bag 100, except for the distinctions noted herein. Therefore, like reference numbers are used to represent like structures. In particular, the bag 200 is shown with the removable top 120 detached from the top edge 122 of the top section 122. In addition, rather than an oval preperforated section 154, the bag 200 includes a substantially rectangular preperforated section 202. In the rectangular configuration, the edges of the preperforated section 202 can be rounded to prevent tearing of the opening 156 when the bag 200 is in the hanging orientation.

In some embodiments, the notation area 150 can include labels 204 for each line 152 indicating the type of information to be written (e.g., name, date, or the like). In some embodiments, one or more sections of the bag 200 can include graphics 206 thereon (e.g., logos, text, combinations thereof, or the like). In some embodiments, the bottom section 118 can include a markers 208 printed thereon to provide a visual scale indicating the volume of milk within the inner chamber 114.

Figure 3:
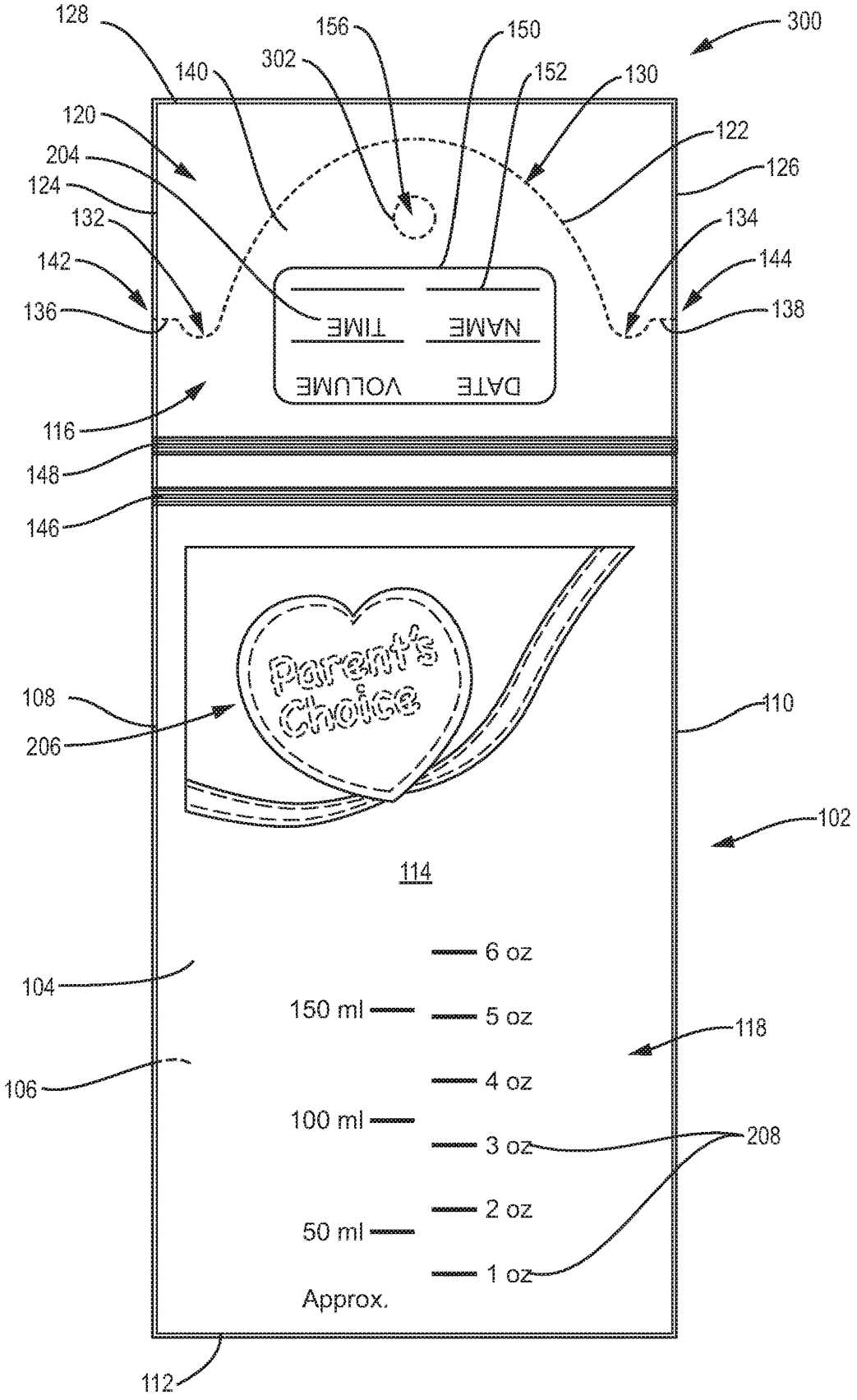
FIG. 3 is a schematic front view of an exemplary milk storage bag of the present disclosure including a removable top.

FIG. 3 is a front view of an exemplary milk storage bag 300 (hereinafter "bag 300") of the present disclosure. The bag 300 can be substantially similar in structure and function to the bag 100, 200, except for the distinctions noted herein. Therefore, like reference numbers are used to represent like structures. In particular, rather than an oval preperforated section 154, the bag 300 includes a substantially circular preperforated section 302. In addition, the bag 300 includes graphics 206 and markers 208 printed on the bottom section 118.

Figure 4:
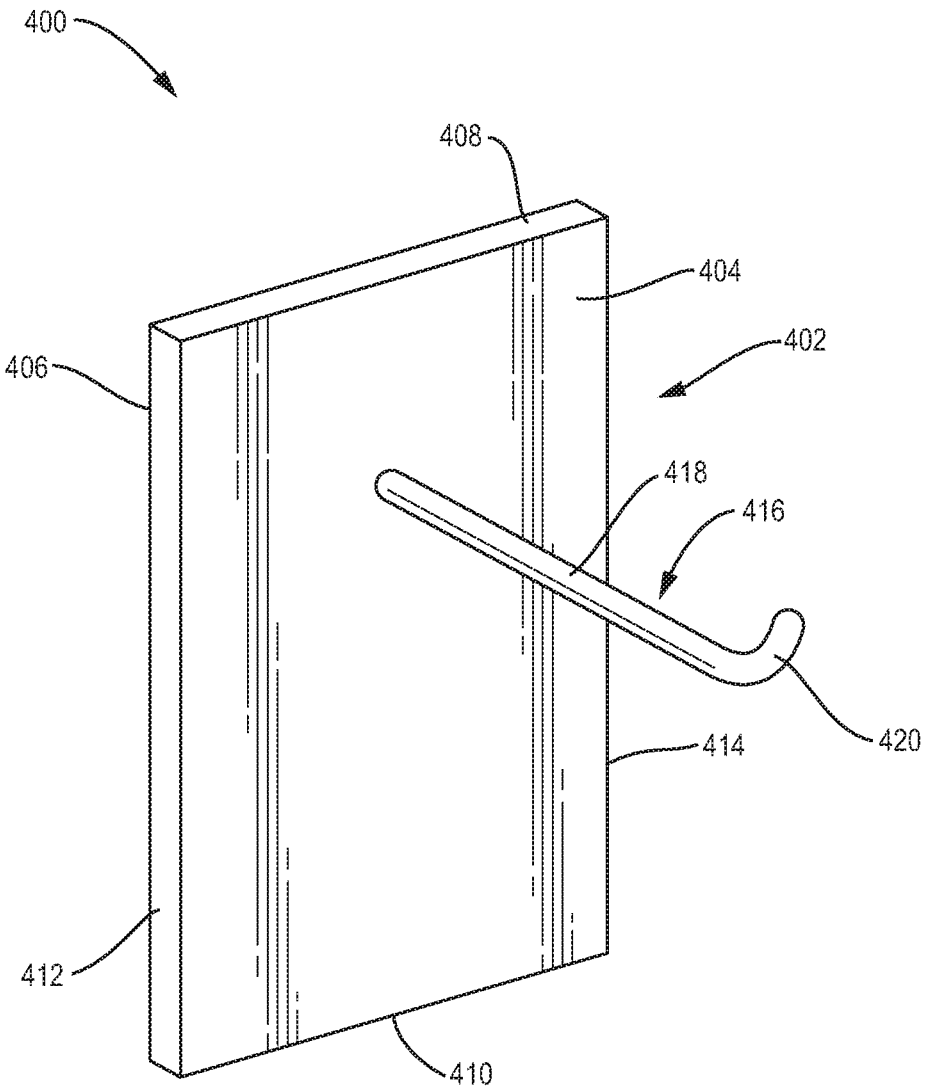
FIG. 4 is a schematic perspective view of an exemplary hanging apparatus of the present disclosure.

FIG. 4 is a perspective view of an exemplary hanging apparatus 400 of the present disclosure. The hanging apparatus 400 generally includes a mounting section 402 defining a body of the hanging apparatus 400. The mounting section 402 can define a substantially planar configuration including a front surface 404, a rear surface 406, a top surface 408, a bottom surface 410, and side surfaces 412, 414. The rear surface 406 can be configured to be mounted to a structure (e.g., a wall or rack within the freezer). In some embodiments, one or more portions of the rear surface 406 can include adhesive for securing the mounting section 402 to the structure.

The hanging apparatus 400 includes an extension 416 protruding from the front surface 404 of the mounting section 402. In some embodiments, the extension 416 can include an elongated linear section 418 and a curved end 420 forming a hook. The extension 416 can support one or more bags 100, 200, 300 thereon. For example, the hanging apparatus 400 can be mounted within the freezer and the bags 100, 200, 300 can be supported on the extension 416 in a hanging orientation by passing the extension 416 through the opening 156 in the body 102. In particular, the preperforated section 154, 202, 302 is initially removed from the body 102 to expose the opening 156, and the extension 416 is passed through the opening 156 to hang the bag 100, 200, 300 within the freezer. Several bags 100, 200, 300 can thereby be supported within the freezer in an organized manner.

Figure 5:
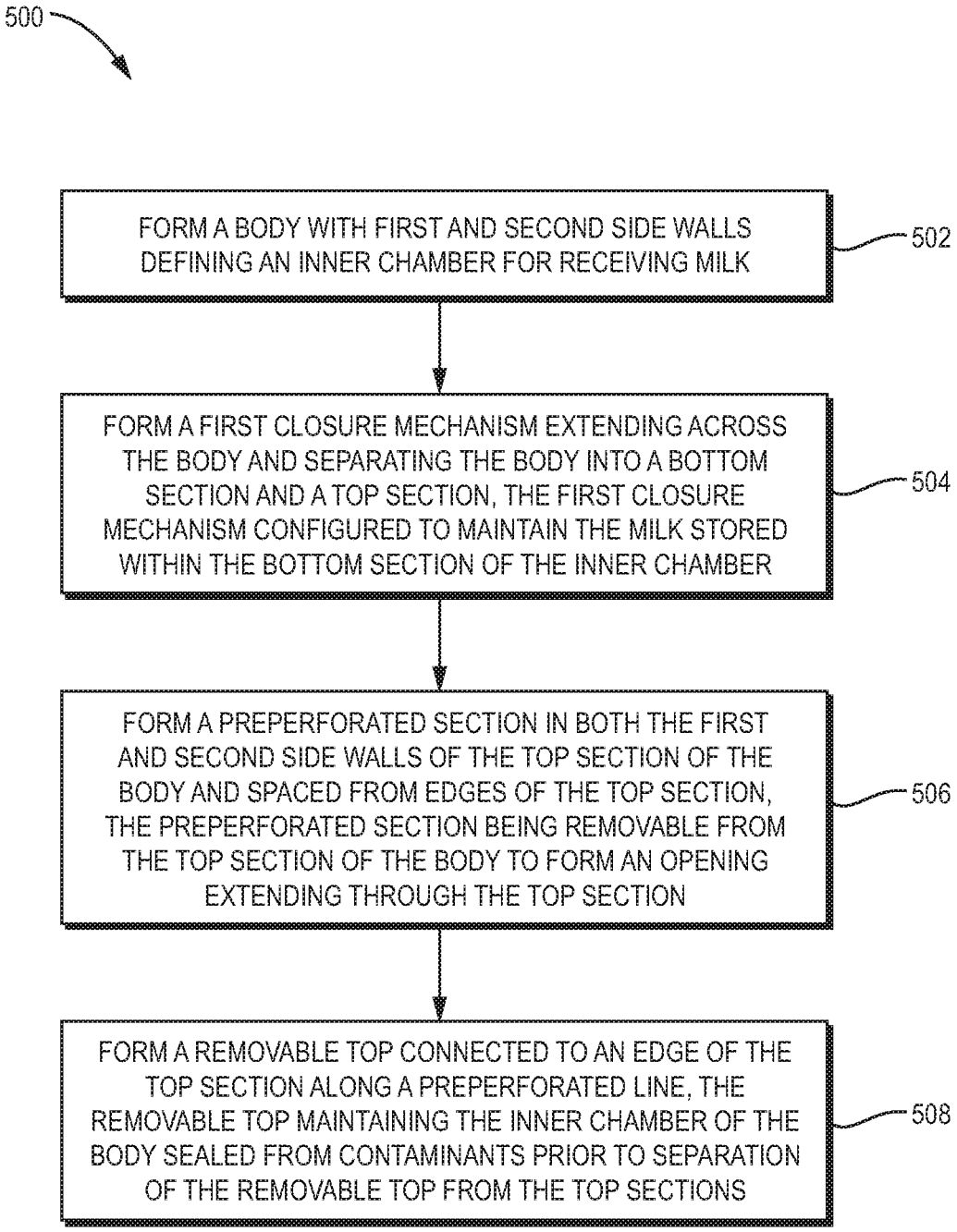
FIG. 5 is a flowchart illustrating a process of fabricating an exemplary milk storage bag in accordance with embodiments of the present disclosure.

FIG. 5 is a flowchart illustrating an exemplary process 500 of fabricating a milk storage bag. To begin, at step 502, a body is formed with the first and second side walls to define an inner chamber for receiving milk. At step 504, a first closure mechanism is formed extending across the body and separating the body into a bottom section and a top section. The first closure mechanism is configured to maintain the milk stored within the bottom section of the inner chamber.

At step 506, a preperforated section is formed in both the first and second side walls of the top section of the body and spaced from edges of the top section. The preperforated section is removable from the top section of the body to form an opening extending through the top section. At step 508, a removable top connected to an edge of the top section along a preperforated line is formed. The removable top maintains the inner chamber of the body sealed from contaminants prior to separation of the removable top from the top section.

Figure 6:
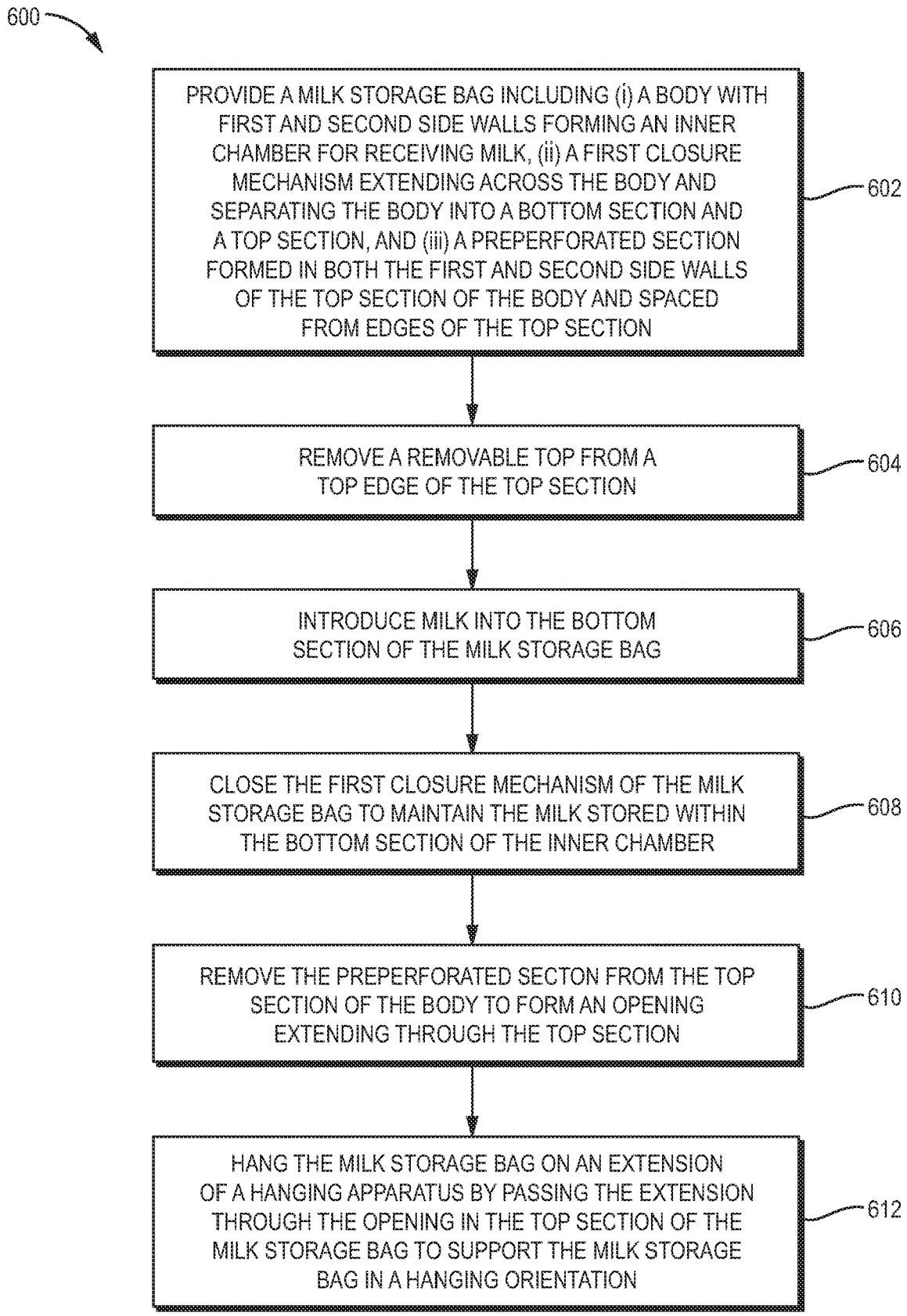
FIG. 6 is a flowchart illustrating a process of implementing an exemplary milk storage bag in accordance with embodiments of the present disclosure.

FIG. 6 is a flowchart illustrating an exemplary process 600 of implementing a milk storage bag. To begin, at step 602, a milk storage bag as disclosed herein is provided. At step 604, the removable top is removed from the top edge of the top section. At step 606, milk is introduced into the bottom section of the milk storage bag. At step 608, the first closure mechanism of the milk storage bag is closed to maintain the milk stored within the bottom section of the inner chamber. At step 610, the preperforated section is removed from the top section of the body to form an opening extending through the top section. At step 612, the milk storage bag is hung on an extension of a hanging apparatus by passing the extension through the opening in the top section of the milk storage bag to support the milk storage bag in a hanging orientation.

Thus, the exemplary milk storage bag and hanging apparatus provide a system for hanging milk storage bags within the freezer in an organized manner. In particular, the preperforated section allows the user to create a hole in the top section of the milk storage bag after milk has been sealed within the inner chamber for hanging on the hanging apparatus. Thus, the milk can be introduced into the milk storage bag without spillage through a preformed hole, and can further be positioned in a hanging orientation within the freezer for future use.

While exemplary embodiments have been described herein, it is expressly noted that these embodiments should not be construed as limiting, but rather that additions and modifications to what is expressly described herein also are included within the scope of the present disclosure. Moreover, it is to be understood that the features of the various embodiments described herein are not mutually exclusive and can exist in various combinations and permutations, even if such combinations or permutations are not made express herein, without departing from the spirit and scope of the present disclosure.

The invention claimed is:

1. A milk storage system, comprising:

a milk storage bag including:

a body with first and second side walls forming an inner chamber for receiving milk, a first closure mechanism extending across the body and separating the body into a bottom section and a top section, the first closure mechanism maintaining the milk stored within the bottom section of the inner chamber, the top section having a first side edge, a second side edge opposite the first side edge, and a top edge interconnecting the first side edge and the second side edge, the top edge including:

a concave central region curving downwards from a center of the top edge, a first convex region extending from one end of the concave central region, a second convex region extending from an opposite end of the concave central region, a first straight linear region extending from an end of the first convex region in a direction toward, and intersecting, the first side edge of the top section, and a second straight linear region extending from an end of the second convex region in a direction toward, and intersecting, the second side edge of the top section, a preperforated section formed in both the first and second side walls of the top section of the body and spaced an equal distance from each of the first and second side edges of the first and second side walls, the preperforated section being removable from the top section of the body to form an opening extending through the top section; and a removable top connected to the top edge of the top section along a preperforated line, the removable top having a convex central region along a bottom edge of the removable top corresponding to and connecting to the concave central region along the preperforated line; and a hanging apparatus including a mounting section and an extension protruding from the mounting section, the extension passing through the opening in the top section of the milk storage bag to support the milk storage bag in a hanging orientation.

2. The milk storage system of claim 1, wherein the hanging apparatus is configured and dimensioned to be removably mounted to a structure via the mounting section.

3. The milk storage system of claim 1, wherein the body of the milk storage bag is formed from a flexible material.

4. The milk storage system of claim 1, wherein the body of the milk storage bag is transparent.

5. The milk storage system of claim 1, wherein the top section includes an area including a material configured to be written on.

6. The milk storage system of claim 1, wherein the body comprises a second closure mechanism extending across the body between the first closure mechanism and the preperforated section.

7. The milk storage system of claim 1, wherein the preperforated section defines a round configuration.

8. The milk storage system of claim 1, wherein the preperforated section defines an oval configuration.

9. The milk storage system of claim 1, wherein the preperforated section includes a reinforced perimeter to provide strength to the opening when the milk storage bag is in the hanging orientation.

10. The milk storage system of claim 1, wherein prior to separation of the removable top from the top section along the preperforated line, the inner chamber of the body is sealed from contaminants.

11. A milk storage bag, comprising:

a body with first and second side walls forming an inner chamber for receiving milk;

a first closure mechanism extending across the body and separating the body into a bottom section and a top section, the first closure mechanism maintaining the milk stored within the bottom section of the inner chamber, the top section having a first side edge, a second side edge opposite the first side edge, and a top edge interconnecting the first side edge and the second side edge, the top edge including a concave central region curving downwards from a center of the top edge of the top section, a first convex region extending from one end of the concave central region, a second convex region extending from an opposite end of the concave central region, a first straight linear region extending from an end of the first convex region in a direction toward, and intersecting, the first side edge of the top section, and a second straight linear region extending from an end of the second convex region in a direction toward, and intersecting, the second side edge of the top section;

a preperforated section formed in both the first and second side walls of the top section of the body and spaced an equal distance from each of the first and second side edges of the first and second side walls, the preperforated section being removable from the top section of the body to form an opening extending through the top section; and a removable top connected to the top edge of the top section along a preperforated line, the removable top having a convex central region along a bottom edge of the removable top corresponding to and connecting to the concave central region along the preperforated line.

12. The milk storage bag of claim 11, wherein the top section includes an area configured to be written on.

13. The milk storage bag of claim 11, comprising a second closure mechanism extending across the body between the first closure mechanism and the preperforated section.

14. The milk storage bag of claim 11, wherein the preperforated section defines a round configuration.

15. The milk storage bag of claim 11, wherein the preperforated section includes a reinforced perimeter to provide strength to the opening when the milk storage bag is positioned in a hanging orientation.

16. The milk storage bag of claim 11, wherein prior to separation of the removable top from the top section along the preperforated line, the inner chamber of the body is sealed from contaminants.

* * * * *